US007594843B2

(12) United States Patent
Vetuskey

(10) Patent No.: US 7,594,843 B2
(45) Date of Patent: Sep. 29, 2009

(54) TOY HAVING AN ELECTRONIC INTERACTIVE DEVICE THAT IS RESPONSIVE TO A ROTATED AND LAUNCHED OBJECT

(75) Inventor: Brendon Vetuskey, Malibu, CA (US)

(73) Assignee: Jakks Pacific, Inc., Malibu, CA (US)

( * ) Notice: Subject to any disclaimer, the term of this patent is extended or adjusted under 35 U.S.C. 154(b) by 318 days.

(21) Appl. No.: 11/315,700

(22) Filed: Dec. 20, 2005

(65) Prior Publication Data

US 2006/0160464 A1 Jul. 20, 2006

Related U.S. Application Data

(63) Continuation-in-part of application No. 11/183,118, filed on Jul. 14, 2005.

(60) Provisional application No. 60/604,283, filed on Aug. 25, 2004, provisional application No. 60/730,080, filed on Oct. 24, 2005.

(51) Int. Cl.
*A63H 27/127* (2006.01)

(52) U.S. Cl. ..... 446/39; 446/429; 446/430; 463/7; 463/58; 463/66

(58) Field of Classification Search ..... 446/39, 446/429, 430; 463/7, 58, 66
See application file for complete search history.

(56) References Cited

U.S. PATENT DOCUMENTS

| | | | | |
|---|---|---|---|---|
| D97,019 | S | | 9/1935 | Sedivy |
| D102,956 | S | | 1/1937 | Prince |
| 2,159,974 | A | | 5/1939 | Lohr |
| D144,077 | S | | 3/1946 | Shaffer |
| 2,551,982 | A | | 5/1951 | Verkins |
| D171,251 | S | | 1/1954 | Courtney |
| 2,697,306 | A | | 12/1954 | Muller |
| 2,788,613 | A | | 4/1957 | Gelfand et al. |
| 2,792,899 | A | | 5/1957 | Piatti |
| 3,124,007 | A | | 3/1964 | Swinney |
| 3,236,323 | A | | 2/1966 | Austin |
| 3,492,758 | A | | 2/1970 | Sato |
| 3,645,529 | A | * | 2/1972 | Andrews ..... 446/259 |
| D226,188 | S | | 1/1973 | Reed |
| D231,441 | S | | 4/1974 | Tratner |
| 3,886,682 | A | | 6/1975 | Ieda et al. |
| D238,158 | S | | 12/1975 | Mitchell |
| 3,955,429 | A | | 5/1976 | Holden |
| 3,995,392 | A | * | 12/1976 | Goldfarb et al. ..... 446/58 |
| 4,053,029 | A | | 10/1977 | Darda |

(Continued)

*Primary Examiner*—Gene Kim
*Assistant Examiner*—Urszula M Cegielnik
(74) *Attorney, Agent, or Firm*—Tope-Mckay & Associates

(57) ABSTRACT

A toy comprises a housing connected with a launcher to rotate and launch an object. The launcher comprises a driving element to form a drive connection with a receiving element on the object. The launcher is connected with a launcher rotating system, which imparts a rotary movement to the launcher. When the launcher ceases to accelerate the object, the receiving element disengages from the drive connection and launches the object. An interactive device is attached with the housing to increase stimulation and enjoyment. The interactive device operates in conjunction with spinning and launching the object from the toy such that it provides an output in response to a user imparting a rotary motion to the object. Non-limiting examples of such interactive devices include an electronic game, gauges, and a sound-producing mechanism.

18 Claims, 12 Drawing Sheets

U.S. PATENT DOCUMENTS

D258,426 S 3/1981 Dunan
4,293,052 A 10/1981 Daswick et al.
4,309,841 A 1/1982 Asano
4,345,402 A 8/1982 Hanson et al.
4,363,186 A 12/1982 Goldfarb et al.
4,373,290 A 2/1983 Goldfarb et al.
D268,920 S 5/1983 Bragdon
4,387,604 A 6/1983 Maher
4,443,967 A 4/1984 Jones et al.
4,475,305 A 10/1984 Kawakami et al.
4,483,096 A 11/1984 Gabler et al.
D276,714 S 12/1984 Omholt
4,526,554 A 7/1985 Goldfarb et al.
4,529,055 A 7/1985 Gotoh et al.
4,529,389 A 7/1985 Kennedy et al.
4,547,174 A 10/1985 Lee et al.
4,556,396 A 12/1985 Kennedy et al.
4,571,212 A 2/1986 Kakizaki
4,683,986 A 8/1987 Darda et al.
4,685,894 A 8/1987 Beny et al.
4,709,774 A 12/1987 Saito et al.
4,732,569 A 3/1988 Hippely et al.
4,887,688 A 12/1989 Horiike et al.
D305,415 S 1/1990 Miura et al.
4,946,417 A 8/1990 Ishikawa et al.
4,959,035 A 9/1990 Murasaki
5,195,920 A * 3/1993 Collier ..... 446/175
D339,088 S 9/1993 Tako et al.
D340,757 S 10/1993 Chen
5,326,301 A 7/1994 Woodside
5,377,775 A 1/1995 Rush
5,525,086 A * 6/1996 Gentile et al. ..... 446/41
5,545,068 A * 8/1996 Asbaghi ..... 446/39
5,643,036 A 7/1997 Liu et al.
D396,433 S 7/1998 Belker et al.
5,803,790 A 9/1998 Tilbor et al.
D401,643 S 11/1998 Rey et al.
6,024,627 A 2/2000 Tilbor et al.
D431,611 S 10/2000 Dilabio et al.
6,227,934 B1 5/2001 Isaksson et al.
6,325,690 B1 * 12/2001 Nelson ..... 446/242
D455,678 S 4/2002 Schroeder et al.
D456,748 S 5/2002 Keating et al.
6,439,948 B1 8/2002 Ostendorff et al.
6,540,583 B1 4/2003 Hoeting et al.
6,565,411 B1 5/2003 Fosbenner et al.
6,590,386 B1 * 7/2003 Williams ..... 324/178
D482,301 S 11/2003 Chosa
D491,109 S 6/2004 Walters
6,807,959 B1 * 10/2004 Murdock et al. ..... 124/61
6,854,547 B2 2/2005 Moll et al.
D503,361 S 3/2005 Everitt
D506,953 S 7/2005 Everitt et al.
2001/0004578 A1 6/2001 Jaffe
2003/0077979 A1 4/2003 Hoeting et al.
2003/0102657 A1 6/2003 Kuo

* cited by examiner

TOY HAVING AN ELECTRONIC INTERACTIVE DEVICE THAT IS RESPONSIVE TO A ROTATED AND LAUNCHED OBJECT

PRIORITY CLAIM

The present application is a Continuation-In-Part application, claiming the benefit of priority of U.S. patent application Ser. No. 11/183,118, filed Jul. 14, 2005, entitled "Toy for Rotating and Launching an Object," which is a non-provisional patent application claiming the benefit of priority of U.S. Provisional Patent Application No. 60/604,283, filed Aug. 25, 2004, entitled "Wheel Spinning Launcher and Wheel Toy." The present application also claims the benefit of priority of U.S. Provisional Application No. 60/730,080, filed Oct. 24, 2005, entitled, "Rotating Wheel/Propeller Toy."

BACKGROUND OF THE INVENTION (1) Technical Field

The present invention relates to a toy for rotating and launching an object, and more particularly to a toy having a launching mechanism and an electronic interactive device that is responsive to a rotated and launched object.

(2) Description of Related Art

Toy launchers are well known in the art. Toys that accelerate and launch gliders, helicopters, cars, and parachutes are well documented. One method of launching a toy is through a rotary motion, often utilizing a gear system to turn a shaft that rotates the toy.

An example of one launcher disclosed in U.S. Pat. No. 3,701,216, issued to Smith, III et al. (hereinafter "the Smith patent"). The launcher taught in the Smith patent uses a gear rack to drive a gear train and rotate a wheel that is mounted on a shaft. As the gear rack is withdrawn from the toy, a wheel ejector coupled to the gear rack pivots to force the wheel off of the shaft and launch the wheel.

The devices according to the Smith patent have several shortcomings, the first of which is the need for a separate mechanical ejector to release the wheel from the toy. In addition to adding to the cost to manufacture the toy, the wheel ejector device adds to the complexity of design of the toy.

Another shortcoming of the devices made according to the Smith patent is the possibility of causing injury to the user if the wheel is launched in the direction of the user. If the toy is particularly oriented, the wheel will rotate and launch toward the user, risking injury.

To remove such a risk, the Applicants of the present invention previously disclosed a toy wheel launcher. U.S. patent application Ser. No. 11/183,118, entitled, "Toy for Rotating and Launching an Object," discloses a toy launcher for launching a toy wheel upon pulling a strip. The toy launcher includes a cost-effective launching mechanism built into the design of the toy that is capable of preventing the toy wheel from being launched in the direction of the user.

In some circumstances, it may be desirable to include interactive features to the toy launcher. Thus, a continuing need exists for a toy launcher with interactive features.

SUMMARY OF THE INVENTION

The present invention overcomes the aforementioned limitations and fills the aforementioned needs by providing a toy for rotating and launching an object. The toy comprises a housing with a launcher extending from the housing. The launcher is configured to impart a rotary motion to an object.

The launcher comprises a driving element configured to engage a receiving element. The receiving element is attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection. A launcher rotating system is mounted inside the housing and connected with the launcher. The launcher rotating system is configured to impart a rotary motion to the launcher. An interactive device is connected with the housing. The interactive device is configured to provide an output in response to a user imparting a rotary motion to the object.

In another aspect, the interactive device is a device selected from a group consisting of an electronic game, a sound-producing mechanism, and a gauge for displaying a measure associated with a launched object.

In another aspect, the electronic game includes race staging lights and a timer, where the race staging lights are attached with the housing and are operable for lighting up in a sequential fashion to indicate a start time, such that when the start time is indicated, the timer operates to time and display a user's reaction time between the start time and an actual launch of the object.

Additionally, the race staging lights further include a red light, a yellow light, and a green light that are operable for lighting in a sequential fashion, and wherein the sound-producing mechanism produces three tones that correspond to the red light, the yellow light, and the green light respectively.

In another aspect, the driving element comprises two substantially helical tabs extending in a parallel configuration from the shaft about an axis, the axis running substantially parallel to and substantially centered in the shaft. The receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the edge of the driving element and the edge of the receiving element are formed as matching and interlocking shapes, such that when the edge of the driving element is matched with the edge of the receiving element, an interlocking drive connection is formed.

In yet another aspect, the launcher rotating system comprises a series of interconnected gears and axles, the gears and axles capable of rotating the launcher.

In another aspect, the series of interconnected gears and axles comprises an output axle connected with the launcher. The output axle is coupled with an output gear. The output gear is drivingly connected with an input gear on an input axle. The input axle is connected with an input pinion. The input pinion in drivingly connected with a gear rack, and the gear rack is movably mounted in a guideway in the housing. The gear rack is capable of moving to rotate the input pinion and thereby rotate the launcher rotating system.

The present invention further comprises a stopper configured to selectively engage the gear rack and permit the gear rack to rotate the launcher rotating system in only one direction.

In another aspect, the toy further includes an object. The object is rotationally connected with the receiving element to be rotationally accelerated by the driving element, wherein the object is a wheel, and wherein the receiving element is rotationally connected with the hub of the wheel such that when the receiving element forms a drive connection with the driving element, the movement of the gear rack causes the wheel to rotate.

In another aspect, the gauge is an electronic gauge having a digital display and is a gauge type selected from a group consisting of a speedometer, an odometer, and a tachometer.

In another aspect, the electronic game includes race staging lights. The race staging lights further comprises three yellow lights, a green light, and red light. The yellow lights are flashed three times with the green light thereafter being lit to indicate a start time. The red light is lit when the user launches the wheel before the green light is lit, indicating that the user has fouled the race.

Additionally, the sound-producing mechanism is configured to make revving sounds that correspond to the measurements on the gauge.

Furthermore, the sound-producing mechanism is a rattle that is attached with the launcher rotating system and that produces a sound when the launcher rotating system imparts a rotary motion.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1A:
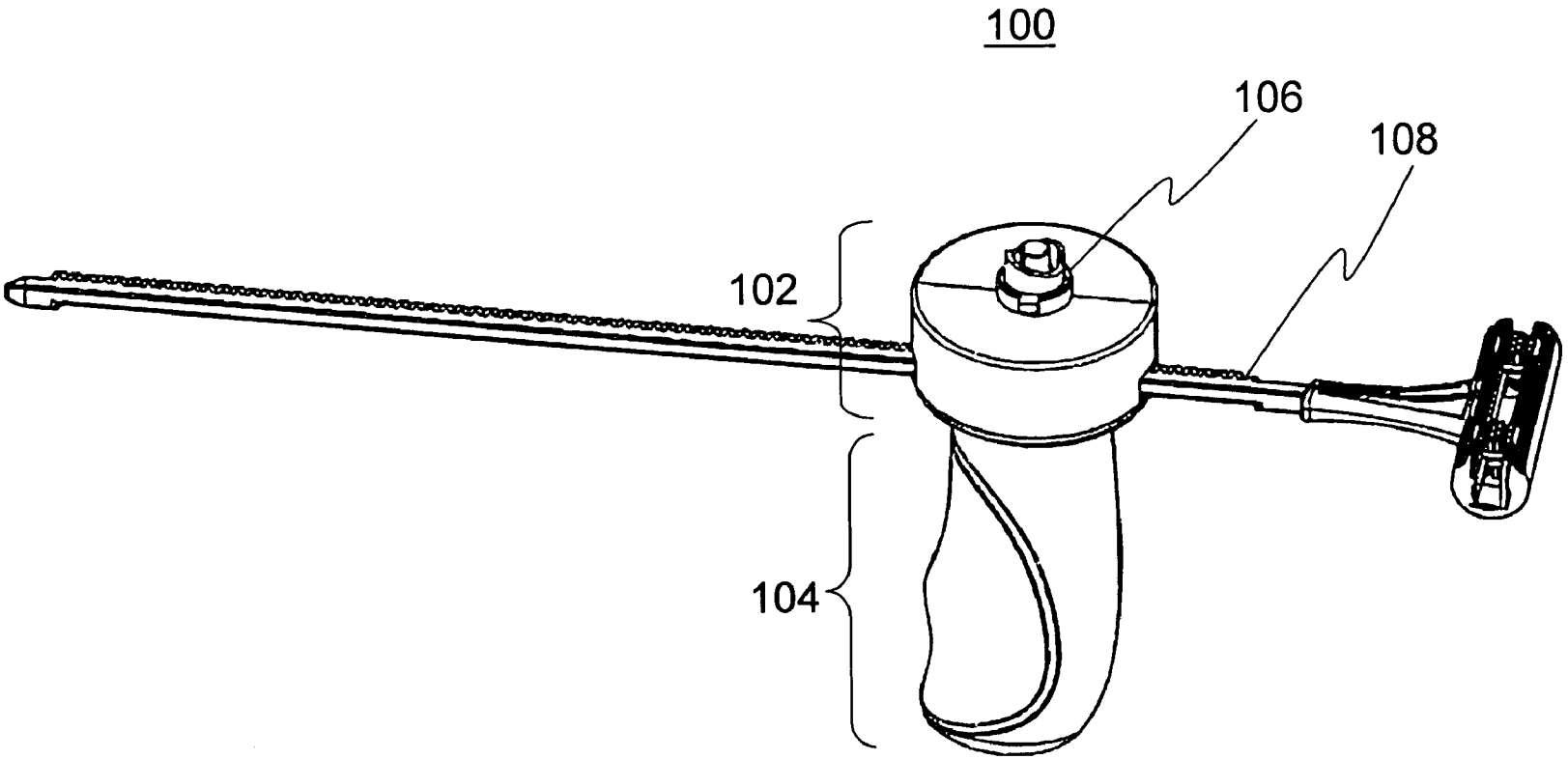
FIG. 1A is an exemplary illustration of a toy according to the present invention, depicting a housing, a handle, a launcher and a gear rack.

The present invention relates to a toy for rotating and launching an object. More specifically, the present invention relates to a launching mechanism for rotating and launching an object. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to provide the reader with a general understanding of the present invention. Next, a description of various aspects of the present invention is provided to give an understanding of the specific details.

(1) Introduction

The present invention relates to a toy for rotating and launching an object. More specifically, the present invention relates to a launcher having an interactive device such as an electronic launching game.

The toy is formed to hold, rotate and release an object such as a toy wheel. A launcher with a pair of helical tabs extends from a shaft on the toy and interlocks with matching tabs on an object to mount the object on the shaft. In one aspect, a removable gear rack is pulled to rotate a gear train in the toy, which in turn rotates the shaft and the launcher, thereby rotating the object mounted to the launcher. When the launcher ceases to accelerate the object, the tabs of the object disengage from the launcher, launching the object forward. The launcher is configured to release the object in only one direction, and a stopper gear will prevent the toy from rotating the object in the direction of a user.

Additionally, the toy further includes at least one interactive device such as an electronic launching game. By way of example, the electronic launching game includes race staging lights to indicate a start time, at which point the user launches the toy wheel. A timer is included to time a user's reaction time between the start time and the actual launch of the toy wheel.

For purposes of clarity, the present invention will first be described in terms of the launching mechanism and operation only. Next, the interactive devices of the present invention will be described in detail.

(2.1.1) Basic Operation

Figure 1B:
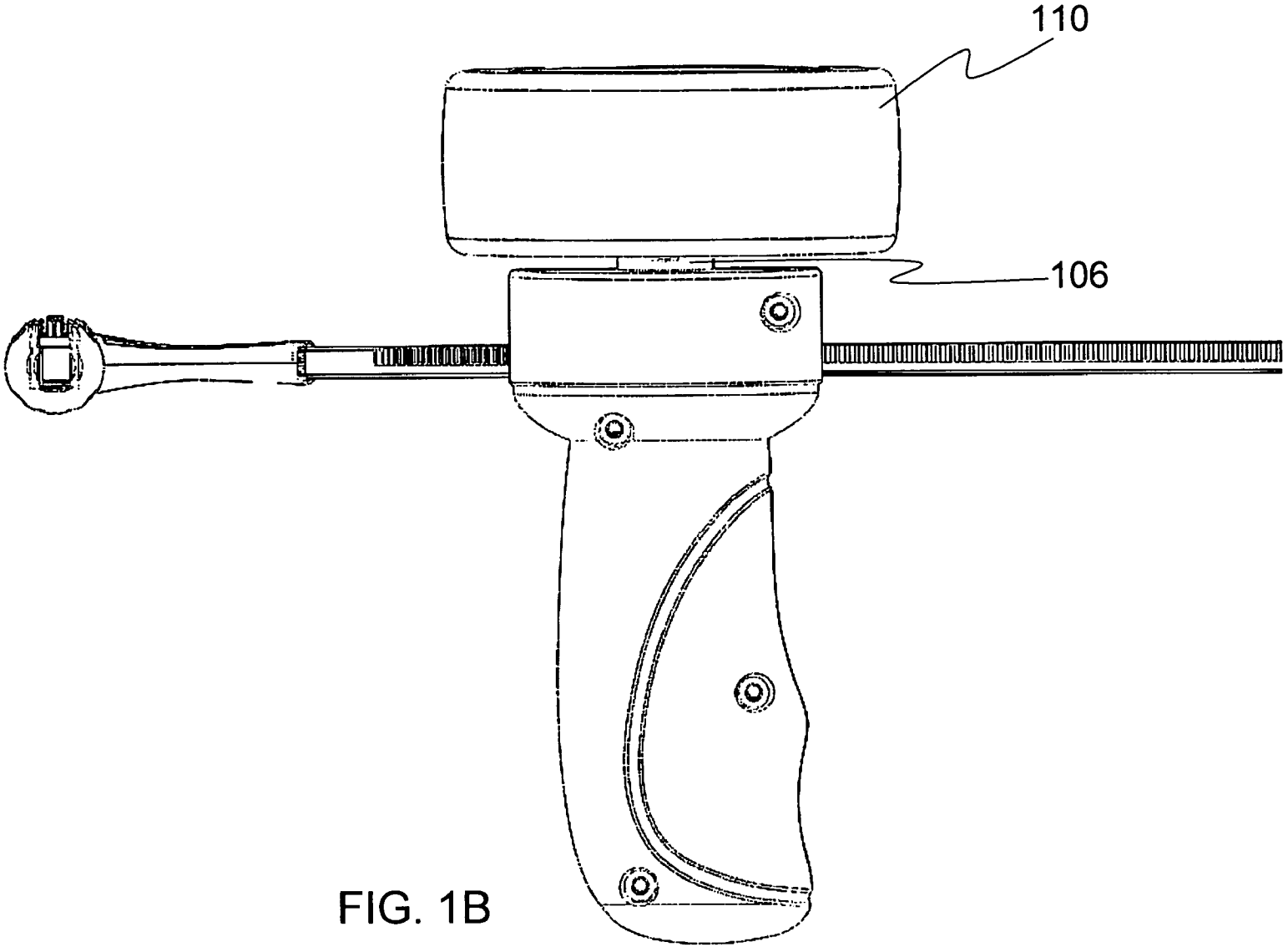
FIG. 1B is an exemplary illustration of a toy according to the present invention, depicting a wheel rotationally connected to the launcher.

In one aspect, as illustrated in FIG. 1A, the toy 100 comprises a housing 102, a handle 104, a launcher 106, and a launcher rotating system (not illustrated) including a gear rack 108. The launcher rotating system is located inside the housing 102, and the launcher rotating system is drivingly connected with the gear rack 108 such that when the gear rack 108 is moved, the launcher rotating system translates the movement of the gear rack 108 into a rotary motion. The launcher rotating system is then drivingly connected with the launcher 106. When an object such as a wheel 110 is connected with the launcher 106, as in FIG. 1B, the launcher 106 rotationally accelerates the wheel 110 until the wheel 110 is released from the launcher 106 and propelled forward. The object described herein is any object that can roll across a surface, a non-limiting example of which includes a wheel and a ball.

Although a gear rack 108 is shown in the aspect of FIG. 1A, one skilled in the art will appreciate that the launcher rotating system can comprise a motor or other manually operated mechanism to cause the rotation of the launcher 106.

(2.1.2) Launcher Mechanism

Figure 2A:
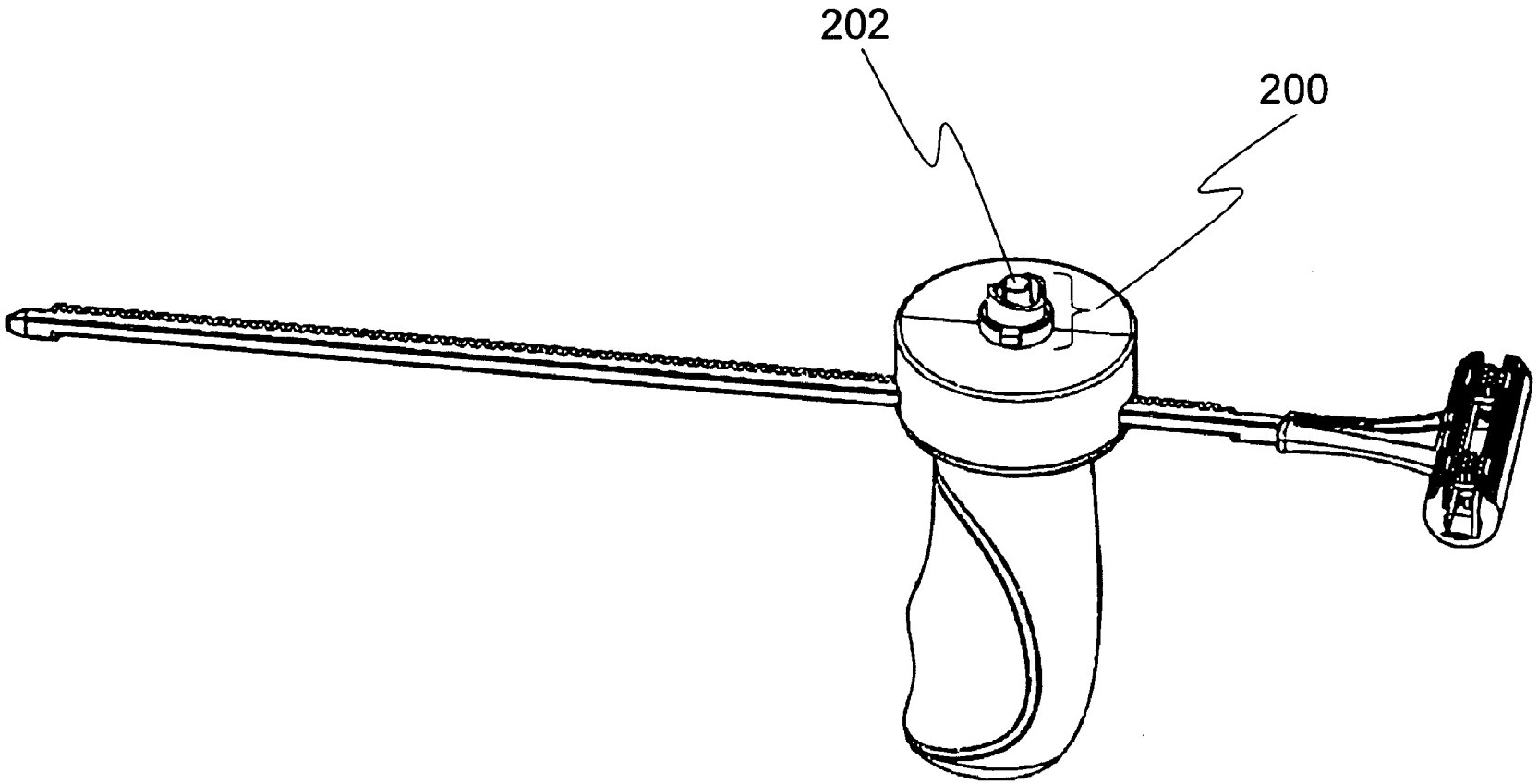
FIG. 2A is an exemplary illustration of a toy according to the present invention, further depicting the launcher.
Figure 2B:
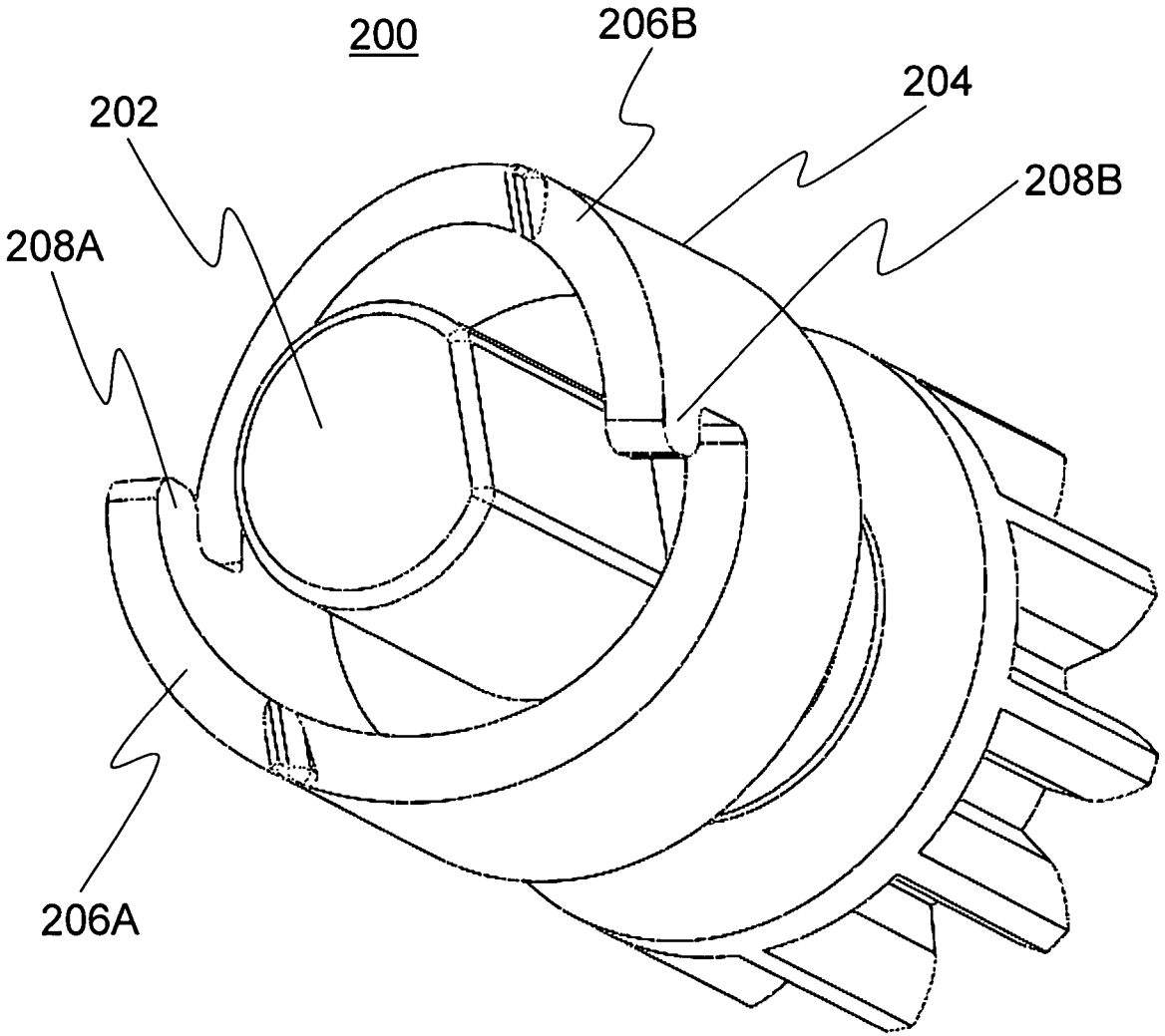
FIG. 2B is an exemplary illustration of a toy according to the present invention, depicting the structure of a driving element of the launcher.

The launcher functions to retain an object, rotate the object, and launch the object, without the need for a manual or mechanical release mechanism. In one aspect, as illustrated in FIG. 2A, the launcher 200 is mounted to an output axle 202 which is drivingly connected with the launcher rotating system (not illustrated). FIG. 2B illustrates the specific design of one aspect of the launcher 200, including a driving element 204. The driving element comprises two identical helical tabs 206A and 206B, which extend outward in parallel configuration from the output axle 202 about an axis, such that the axis is running parallel to and centered in the output axle 202. The edges 208A and 208B of each of the helical tabs 204A and 204B are formed into hook shapes.

Figure 2C:
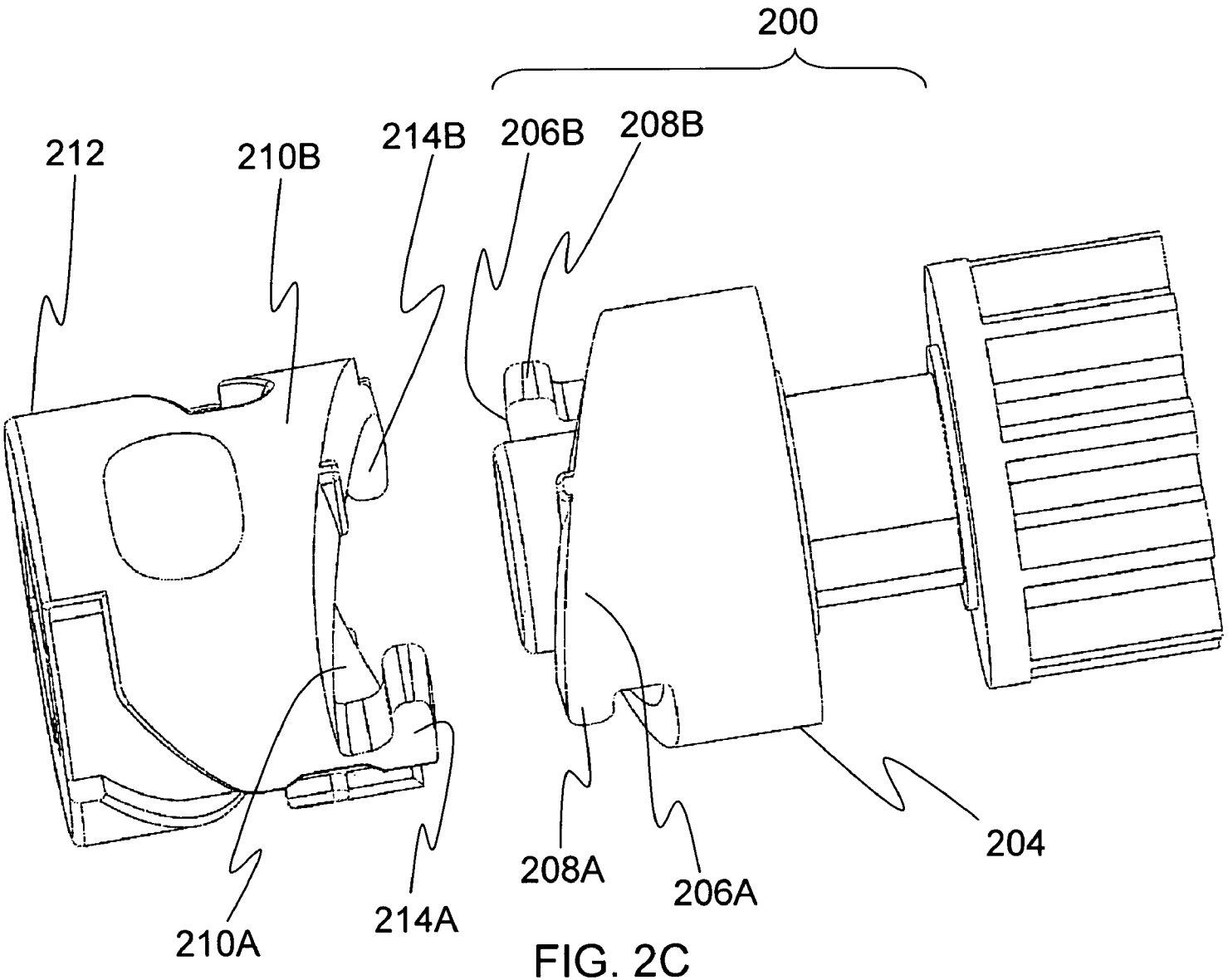
FIG. 2C is an exemplary illustration of a toy according to the present invention, depicting the relationship of the structure of the driving element with a receiving element.
Figure 2D:
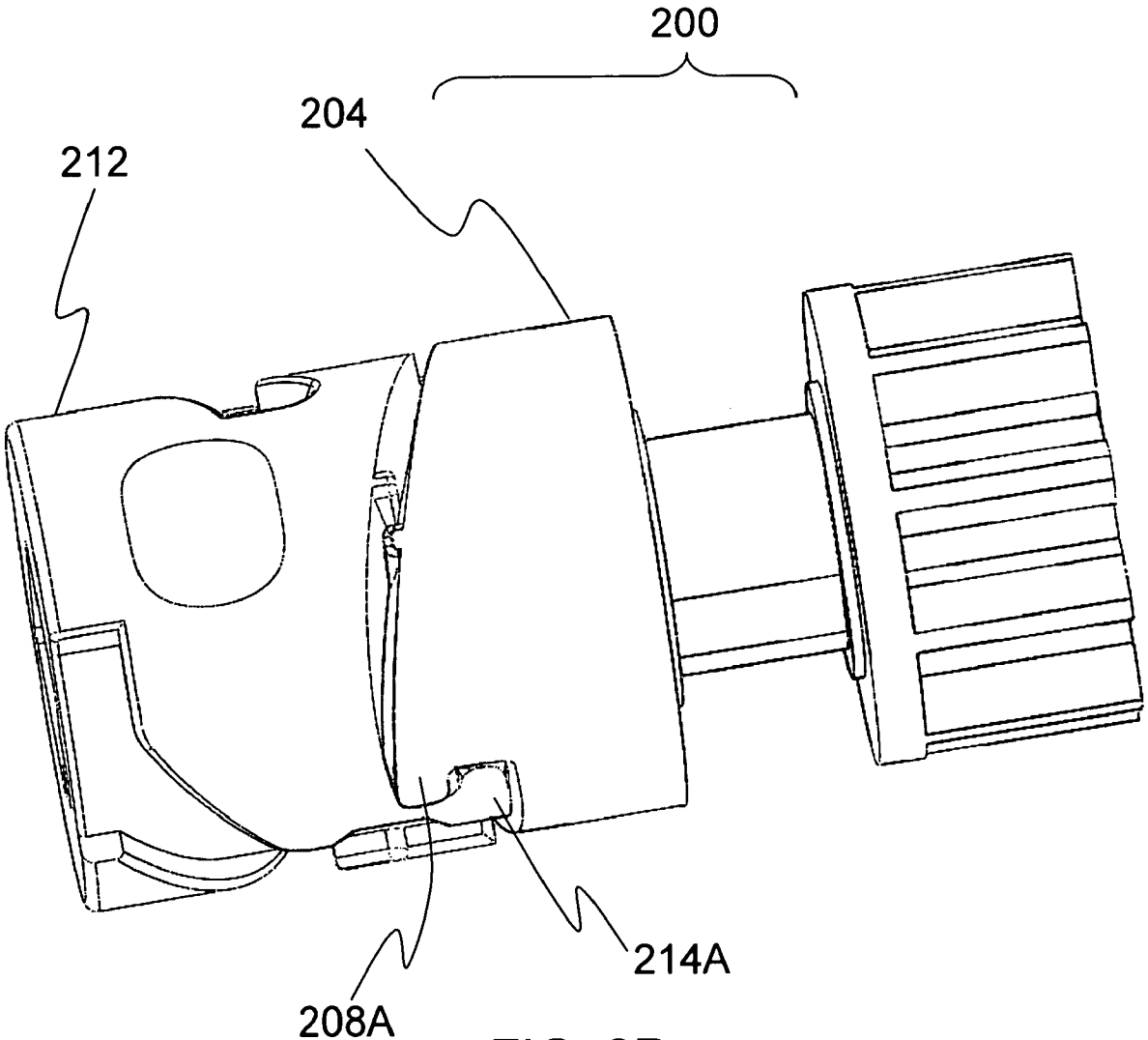
FIG. 2D is an exemplary illustration of a toy according to the present invention, depicting an interlocking drive connection between the driving element and the receiving element.

FIG. 2C illustrates how the helical tabs 206A and 206B of the driving element 204 are configured to interlock, as matching and interlocking shapes, with similar helical tabs 210A and 210B on a receiving element 212, the receiving element 212 connected with an object to be rotated (not illustrated). In particular, the hook-shaped edges 208A and 208B of the driving element 204 are configured to match up with the hook-shaped edges 214A and 214B of the receiving element, forming an interlocking drive connection. The interlocking drive connection, as illustrated in FIG. 2D, allows a user to rotate the toy in any orientation and still maintain the interlocking drive connection between the driving element 204 and the receiving element 212.

Once the interlocking drive connection is made between the driving element 204 and the receiving element 212, the user can pull the gear rack (not illustrated) to rotate the driving element 204 and thereby rotate the object connected with the receiving element 212. When the user pulls the gear rack to the point that it is no longer in contact with the launcher rotating system, the launcher rotating system ceases to accelerate the launcher 200 and the driving element 204. Once the driving element 204 ceases to accelerate the receiving element 212, the receiving element 212 disengages from the driving element 204 and releases the object from the interlocking drive connection. This is accomplished because once the launcher rotating system ceases to rotate the driving element 204, the rate of rotation of the driving element 204 decreases immediately. However, due to the object's inertia, the rotational velocity of the receiving element 212 decreases more slowly, and the object and receiving element rotate away from the driving element 204 and disengage from the interlocking drive connection.

Due to the design of the launcher 200 and specifically the helical tabs 206A and 206B of the driving element 204, the rotation of the launcher 200 will impart a rotation to the receiving element 212 only if rotated in a clockwise direction. If the launcher 200 is rotated in a counter-clockwise direction, the hook-shaped edges 208A and 208B of the driving element will rotate away from the hook-shaped edges 214A and 214B of the receiving element 212 and disengage the interlocking drive connection without imparting any rotational motion to the receiving element 212.

Figure 2E:
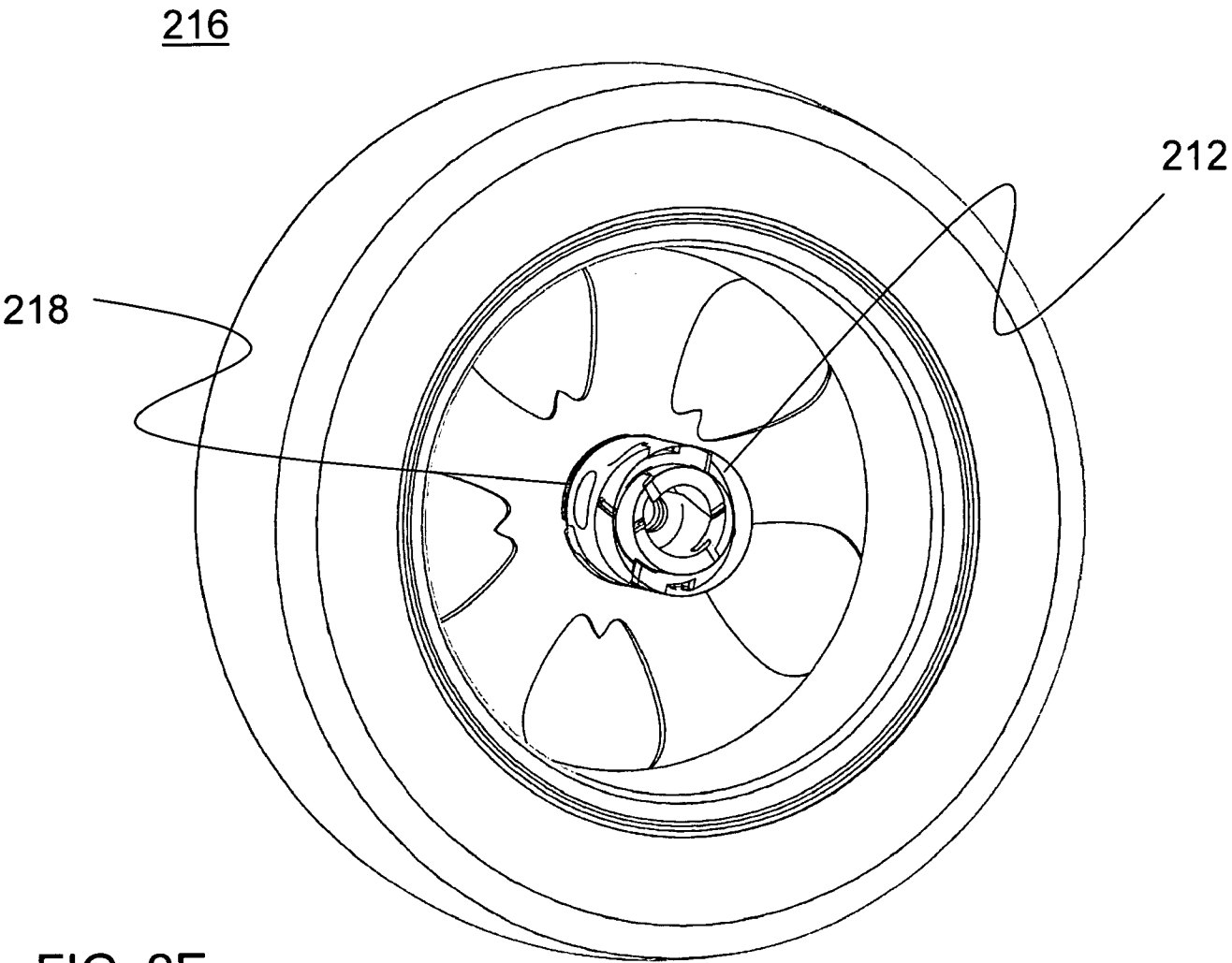
FIG. 2E is an exemplary illustration of a toy according to the present invention, depicting a wheel configured with the receiving element.

In the aspect where the object is a wheel 216, the receiving element 212 is rotationally connected with the hub 218 of the wheel, as illustrated in FIG. 2E.

(2.1.3) Launcher Rotating System

Figure 3A:
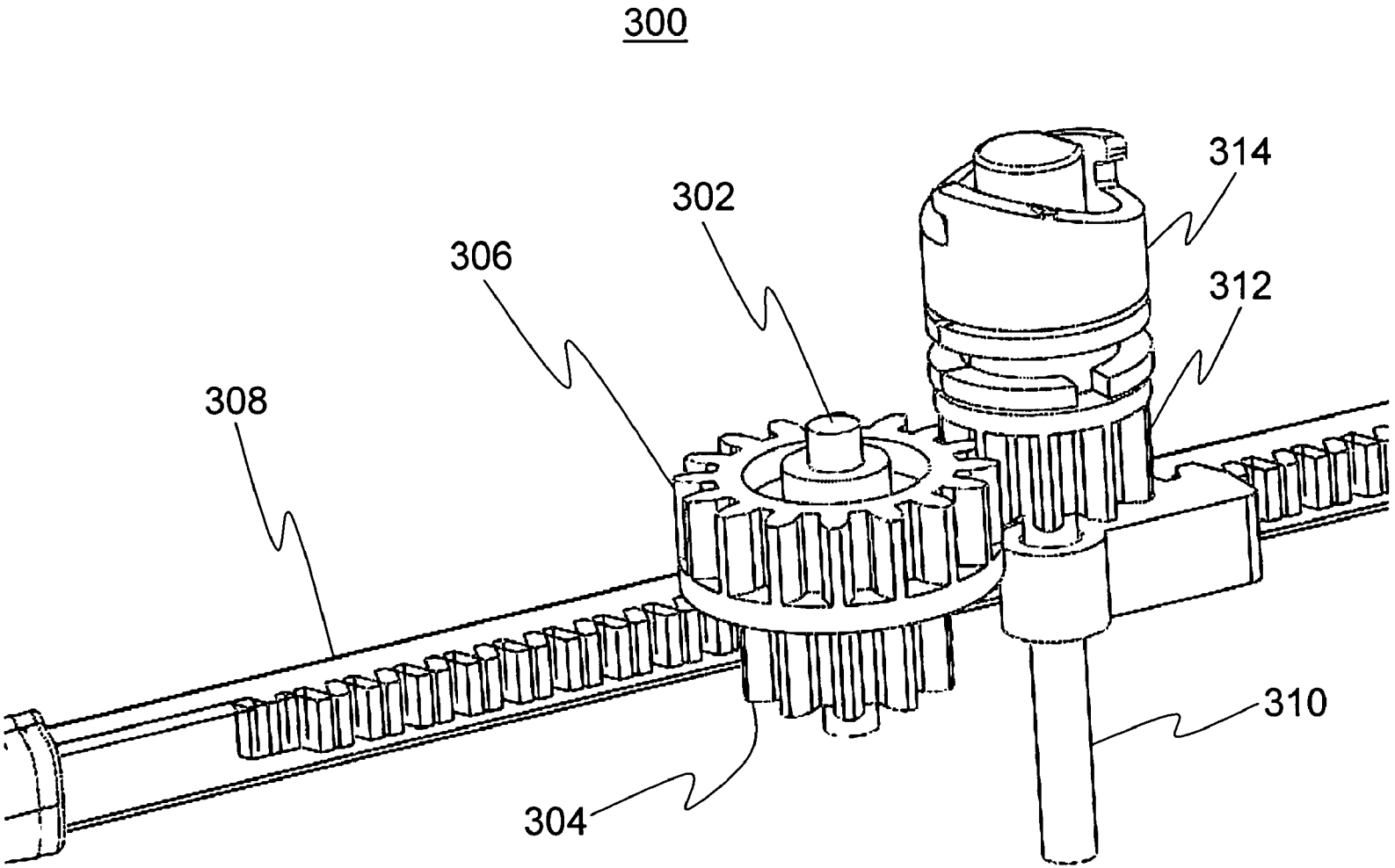
FIG. 3A is an exemplary illustration of a toy according to the present invention, depicting a launcher rotating system comprising an input axle, input pinion, input gear, output gear, output axle and launcher, the input pinion drivingly connected with the gear rack.

The launcher rotating system comprises a series of interconnected gears and axles to impart a rotary motion to the launcher. In one aspect, as illustrated in FIG. 3A, the launcher rotating system 300 comprises an input axle 302 with an input pinion 304 and an input gear 306, where the input pinion 304 is drivingly connected with a gear rack 308. The launcher rotating system 300 further comprises an output axle 310 with an output gear 312, where the output gear 312 is drivingly connected with the input gear 306, and where the output axle 310 is connected with the launcher 314.

Figure 3B:
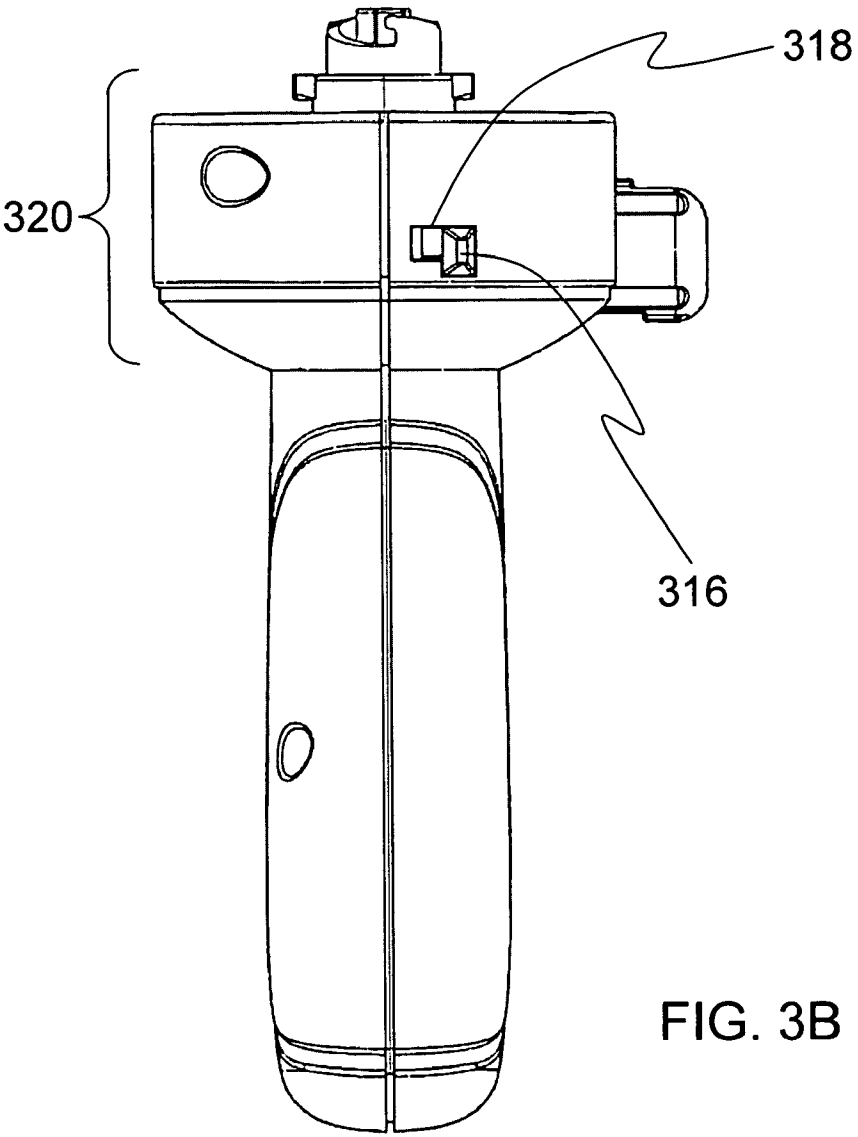
FIG. 3B is an exemplary illustration of a toy according to the present invention, depicting the housing with a guideway for inserting the gear rack.
Figure 3C:
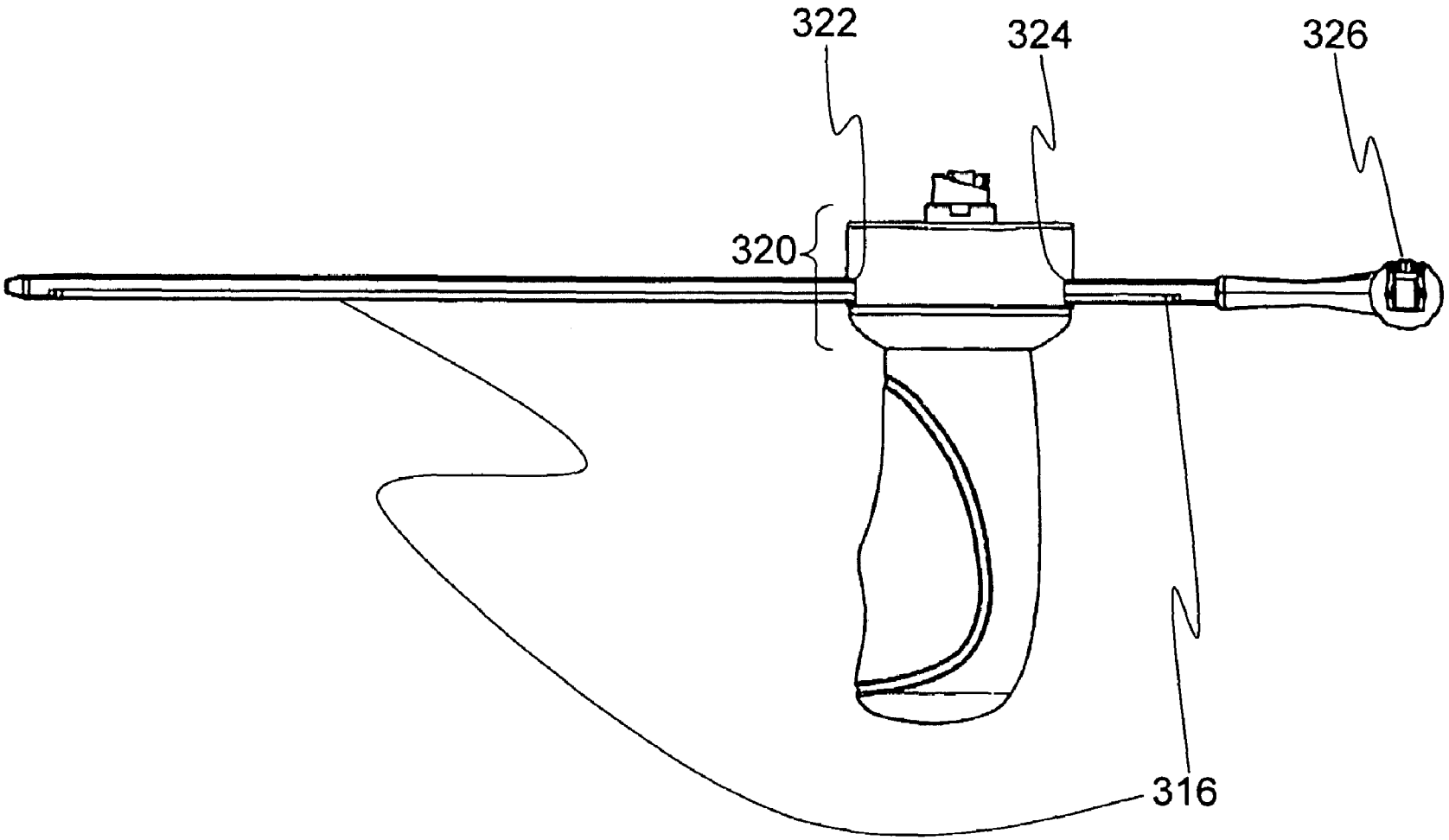
FIG. 3C is an exemplary illustration of a toy according to the present invention, depicting the gear rack inserted into the guideway in the housing.

In one aspect, as illustrated in FIG. 3B, the gear rack 316 is movably mounted in a guideway 318 in the housing 320. FIG. 3C further illustrates how the gear rack 316 is inserted into a guideway (not illustrated) that requires openings 322 and 324 on corresponding ends of the housing 320. The gear rack 316 further comprises a handle 326 for a user to easily grip and pull the gear rack 316.

One skilled in the art will appreciate that by changing the radius of the interconnected gears and input pinions of the launcher rotating system, a desired input-to-output gear ratio can be achieved. For example, the radius of the gears and pinions can be reduced to provide for a faster rotation output to the launcher, due to the fact that a given movement of the gear rack produces more revolutions of the gears and input pinions than are produced with a greater radius of the gears and input pinions.

Additionally, one skilled in the art will appreciate that the gear mechanism described herein is for illustrative purposes and the invention is not intended to be limited thereto, as other gear mechanisms can be envisioned for spinning the toy wheel.

(2.1.4) Stopper Mechanism

Figure 4:
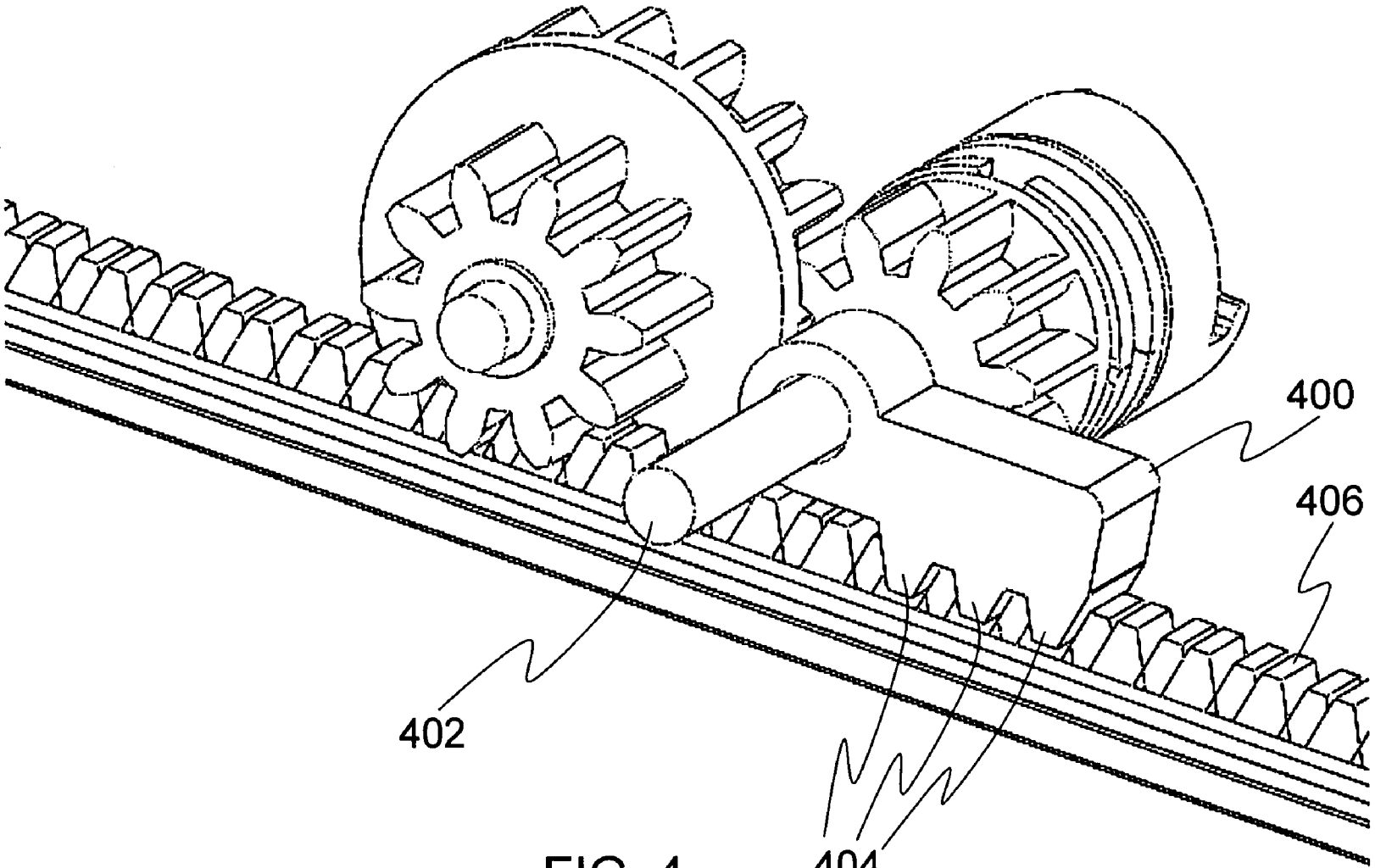
FIG. 4 is an exemplary illustration of a toy according to the present invention, depicting a stopper mechanism rotationally attached to the input axle of the launcher rotating system and interlocking with the gear rack.

An additional aspect of the toy is a stopper for preventing the object from rotating and launching in an undesired direction, e.g., in the direction of a user. In one aspect, illustrated in FIG. 4, the stopper 400 is rotationally attached to the input axle 402 of the launcher rotating system. The stopper 400 is formed with teeth 404 to interlock with the gear rack 406 and prevent the gear rack 406 from moving. The stopper 400 is rotationally configured such that when the user is operating the toy as designed, the stopper 400 does not interact with the gear rack 406. However, if the toy is oriented in a way such that a pull of the gear rack 406 would result in the rotation and launch of the object in the direction of the user, the stopper 400 rotates into a position in which it interlocks with the gear rack 406, thereby preventing the gear rack 406 from being pulled.

One skilled in the art will appreciate that the stopper may consist of any mechanism designed to prevent the rotation and launch of the object in the direction of the user. For example, if the launcher rotating system comprises a motor, the motor may possess a device to detect a particular orientation of the device and thereby prevent the motor from operating in that orientation.

(2.2.1) Interactive Device

Figure 5:
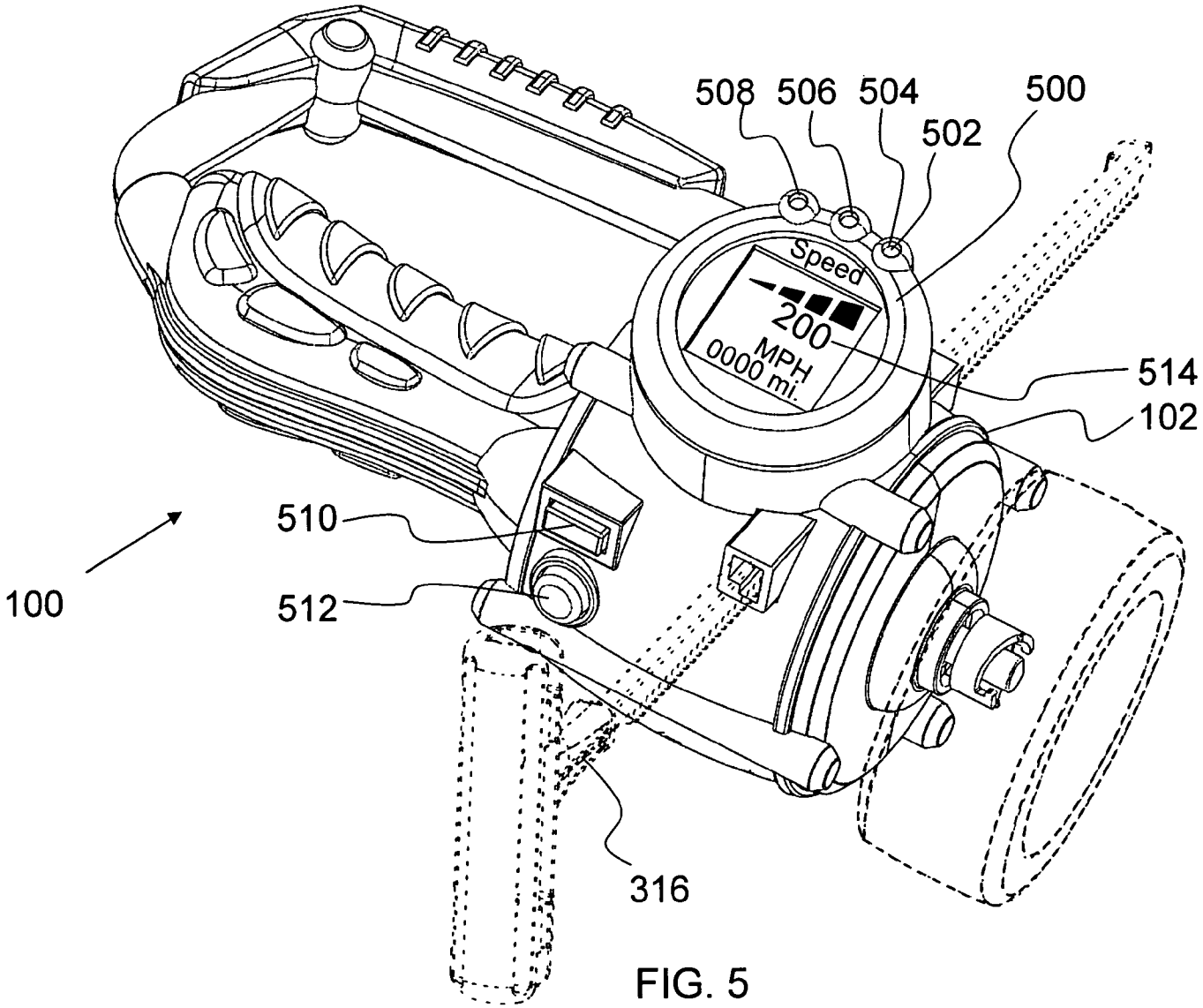
FIG. 5 is an exemplary illustration of a toy according to the present invention, depicting an interactive device attached with the housing.

As shown in FIG. 5, to increase stimulation and enjoyment, an interactive device 500 is included with the toy 100. The interactive device 500 is any mechanism or device that provides an output in conjunction with spinning and launching an object from the toy 100. The interactive device 500 is responsive to a rotary motion being applied to the object. Non-limiting examples of such interactive devices 500 include an electronic game, a gauge, and a sound-producing mechanism. For clarity, each of the interactive devices 500 is described in further detail below.

(2.2.2) Electronic Game

As an interactive device 500, an electronic game is included with the toy 100. The electronic game is any suitable electronic game that operates with launching the object. As a non-limiting example, the electronic game includes race staging lights 502. The race staging lights 502 are any suitable light producing mechanism, a non-limiting example of which includes a light emitting diode (LED). Additionally, the race staging lights 502 are attached with the housing 102 and light up in a sequential fashion to indicate a start time. For example, three race staging lights 502 are included that are illuminated in order from red 504, yellow 506, to green 508 respectively. Upon illumination of the green 508 race staging light 502, the user is prompted to pull the gear rack 316 to launch the object.

In another aspect, the race staging lights 502 include three yellow lights, a green light, and red light. The lights are sequentially lit in the following order: yellow, yellow, yellow, and green. The red light is lit when the user launches the wheel before the green light is lit, indicating that the user has fouled the race. A sound is produced when each light is lit and the sound for the red light is a different tone than that for the green and yellow lights. In another aspect, instead of sequentially lighting the lights, the all three yellow lights are flashed three times with the green light thereafter being lit.

The electronic game further includes a timer to time the user's reaction between the start time (i.e., illumination of the green 508 light) and the actual launch of the toy wheel.

A mode button 510 is included to switch between various interactive features, such as between the electronic game and other features described below. When set in the proper mode (i.e., electronic game mode), depressing a start button 512 begins the electronic game and starts the race staging light 502 countdown.

(2.2.3) Gauges

For further interactivity, at least one gauge 514 is attached with the housing 102. Using the mode button 510, a user can select a gauge mode to turn on and display the applicable gauges. The gauge 514 is either a mechanical gauge or a digital gauge. Additionally, the gauge 514 is any suitable mechanism or device for displaying a measure (i.e., output) associated with a launched object. Non-limiting examples of such a gauge include a tachometer, a speedometer, and an odometer. The tachometer measures the revolutions per minute of the spinning object when a user is pulling the gear rack 316. The speedometer measures an estimated scale (i.e., miles per hour or kilometers per hour) of a launched object. When an odometer is included, the odometer measures an estimated distance (i.e., miles or kilometers) traveled by a launched object.

As can be appreciated by one skilled in the art, in order to operate the gauges 514 and the electronic game, a power source is needed. Thus, a power source compartment is included within the toy 100 to house a power source such as a battery.

(2.2.4) Sound-Producing Mechanism

To provide additional stimulation when launching the object, a sound-producing mechanism is encased within the housing 102. The sound-producing mechanism is any suitable mechanism or device for producing an output (i.e., sound) when a user pulls the gear rack 316. As a non-limiting example, the sound-producing mechanism is a rattle that is attached with the internal gears and that produces a sound when the gears are spun.

In another example, the sound-producing mechanism is an electronic device that produces sounds that correspond to the electronic game and/or gauges. For example, when the race staging lights 502 are lit, the sound-producing mechanism produces tones that correspond to red 504, yellow 506, and green 508 respectively. Additionally, the sound-producing mechanism is configured to make revving sounds that correspond to the measurements on the gauges 514.

What is claimed is:

1. A toy for rotating and launching an object, comprising:

a housing;

a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection;

a launcher rotating system mounted inside the housing and connected with the launcher, the launcher rotating system configured to impart a rotary motion to the launcher;

an interactive device connected with the housing, the interactive device being configured to provide an output in response to a user imparting a rotary motion to the object wherein the launcher rotating system comprises a series of interconnected gears and axles, the gears and axles capable of rotating the launcher;

wherein the series of interconnected gears and axles comprises an output axle connected with the launcher, the output axle coupled with an output gear, the output gear drivingly connected with an input gear on an input axle, the input axle connected with an input pinion, the input pinion in drivingly connected with a gear rack, said gear rack movably mounted in a guideway in the housing, said gear rack capable of moving to rotate the input pinion and thereby rotate the launcher rotating system; and a stopper mechanism formed with teeth to interlock with the gear rack to prevent the gear rack from moving, wherein the stopper mechanism is rotationally attached with the input axle of the launcher rotating system.

2. The toy as set forth in claim 1, wherein the interactive device is a device selected from a group consisting of an electronic game, a sound-producing mechanism, and a gauge for displaying a measure associated with a launched object.

3. The toy as set forth in claim 2, wherein the electronic game includes race staging lights and a timer, where the race staging lights are attached with the housing and are operable for lighting up to indicate a start time, such that when the start time is indicated, the timer operates to time and display a user's reaction time between the start time and an actual launch of the object.

4. The toy as set forth in claim 3, wherein the driving element comprises two substantially helical tabs extending in a parallel configuration from the shaft about an axis, the axis running substantially parallel to and substantially centered in the shaft, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

5. The launcher of claim 4, wherein the edge of the driving element and the edge of the receiving element are formed as matching and interlocking shapes, such that when the edge of the driving element is matched with the edge of the receiving element, an interlocking drive connection is formed.

6. The toy as set forth in claim 5, wherein the stopper is configured to permit the gear rack to rotate the launcher rotating system in only one direction.

7. The toy as set forth in claim 6, wherein the toy further includes an object, the object being rotationally connected with the receiving element to be rotationally accelerated by the driving element, wherein the object is a wheel, and wherein the receiving element is rotationally connected with the hub of the wheel such that when the receiving element forms a drive connection with the driving element, the movement of the gear rack causes the wheel to rotate.

8. The toy as set forth in claim 7, wherein the race staging lights further include a red light, a yellow light, and a green light that are operable for lighting in a sequential fashion, and wherein the sound-producing mechanism produces three tones that correspond to the red light, the yellow light, and the green light respectively.

9. The toy as set forth in claim 7 wherein the race staging lights further comprises three yellow lights, a green light, and red light, where the yellow lights are flashed three times with the green light thereafter being lit to indicate a start time, and where the red light is lit when the user launches the wheel before the green light is lit, indicating that the user has fouled the race.

10. The toy as set forth in claim 2, wherein the gauge is an electronic gauge having a digital display and is a gauge type selected from a group consisting of a speedometer, an odometer, and a tachometer.

11. The toy as set forth in claim 10, wherein the sound-producing mechanism is configured to make revving sounds that correspond to the measurements on the gauge.

12. The toy as set forth in claim 11, wherein the driving element comprises two substantially helical tabs extending in a parallel configuration from the shaft about an axis, the axis running substantially parallel to and substantially centered in the shaft, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

13. The launcher of claim 12, wherein the edge of the driving element and the edge of the receiving element are formed as matching and interlocking shapes, such that when the edge of the driving element is matched with the edge of the receiving element, an interlocking drive connection is formed.

14. The toy as set forth in claim 13, wherein the stopper is configured to permit the gear rack to rotate the launcher rotating system in only one direction.

15. The toy as set forth in claim 14, wherein the toy further includes an object, the object being rotationally connected with the receiving element to be rotationally accelerated by the driving element, wherein the object is a wheel, and wherein the receiving element is rotationally connected with the hub of the wheel such that when the receiving element forms a drive connection with the driving element, the movement of the gear rack causes the wheel to rotate.

16. The toy as set forth in claim 2, wherein the sound-producing mechanism is a rattle that is attached with the launcher rotating system and that produces a sound when the launcher rotating system imparts a rotary motion.

17. The toy as set forth in claim 1, wherein the electronic game includes race staging lights and wherein the race staging lights further comprises three yellow lights, a green light, and red light, where the yellow lights are flashed three times with the green light thereafter being lit to indicate a start time, and where the red light is lit when the user launches the wheel before the green light is lit, indicating that the user has fouled the race.

18. A toy for rotating and launching an object, comprising:

a housing;

a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection;

a launcher rotating system mounted inside the housing and connected with the launcher, the launcher rotating system configured to impart a rotary motion to the launcher;

an interactive device connected with the housing, the interactive device being configured to provide an output in response to a user imparting a rotary motion to the object;

wherein the launcher rotating system comprises a series of interconnected gears and axles, the gears and axles capable of rotating the launcher;

wherein the series of interconnected gears and axles comprises an output axle connected with the launcher, the output axle coupled with an output gear, the output gear drivingly connected with an input gear on an input axle, the input axle connected with an input pinion, the input pinion in drivingly connected with a gear rack, said gear rack movably mounted in a guideway in the housing, said gear rack capable of moving to rotate the input pinion and thereby rotate the launcher rotating system; and a stopper mechanism formed with teeth to interlock with the gear rack to prevent the gear rack from moving, wherein the stopper mechanism is rotationally attached with the input axle of the launcher rotating system;

wherein the interactive device is a device selected from a group consisting of an electronic game, a sound-producing mechanism, and a gauge for displaying a measure associated with a launched object; and wherein the electronic game includes race staging lights and a timer, where the race staging lights are attached with the housing and are operable for lighting up to indicate a start time, such that when the start time is indicated, the timer operates to time and display a user's reaction time between the start time and an actual launch of the object.

* * * * *